US006692829B2

(12) United States Patent
Stubler et al.

(10) Patent No.: US 6,692,829 B2
(45) Date of Patent: Feb. 17, 2004

(54) INDIVIDUALLY PROTECTED STRAND, AND ITS MANUFACTURING PROCESS

(75) Inventors: Jérôme Stubler, Paris (FR); Manuel Peltier, Paris (FR); Jean-Claude Percheron, Vienne en Arthies (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 10/006,107

(22) Filed: Dec. 4, 2001

(65) Prior Publication Data

US 2002/0086158 A1 Jul. 4, 2002

(30) Foreign Application Priority Data

Dec. 4, 2000 (FR) ..... 00 15670

(51) Int. Cl.[7] ..... B28B 3/20

(52) U.S. Cl. ..... 428/379; 428/375; 428/378; 264/176.11

(58) Field of Search ..... 428/375, 378, 428/379; 264/171.11, 172.11, 176.11

(56) References Cited

U.S. PATENT DOCUMENTS 4,623,504 A 11/1986 Smith

FOREIGN PATENT DOCUMENTS

| | | |
|---|---|---|
| EP | 0 323 285 | 7/1959 |
| FR | 2 579 236 | 9/1986 |

*Primary Examiner*—Cynthia H. Kelly
*Assistant Examiner*—J. M. Gray
(74) *Attorney, Agent, or Firm*—Cantor Colburn LLP

(57) ABSTRACT

The strand comprises a group of twisted metal wires, a plastic sheath and a pliant filling compound which fills internal interstices between the twisted wires of the group and a peripheral interstice lying between the periphery of the group and the inner face of the sheath. This peripheral interstice has, in a cross section of the strand, an area of between $P \times e_{min}$ and $0.6 \times S2$, where P is the external perimeter of the group of wires, $e_{min}$=0.05 mm and S2 is the cumulative area of the gaps lying between the periphery of the group and the smallest circle within which the group is inscribed.

5 Claims, 1 Drawing Sheet

INDIVIDUALLY PROTECTED STRAND, AND ITS MANUFACTURING PROCESS

BACKGROUND OF THE INVENTION

The present invention relates to individually protected strands used in civil engineering structures, especially for prestressing or suspending structure portions.

These strands comprise an assembly of metal wires twisted together, which are usually seven in number. The metal wires are frequently subjected to an electrochemical treatment (galvanizing, galfanizing, etc.) providing a certain corrosion resistance.

It is common practice to use uncoated strands, taking care to ensure that they are not placed in a corrosive environment. These strands are placed directly in concrete or within collective sheaths filled with cement grout or with petroleum waxes or greases. The passivity of the cement or the non-corrosivity of the petroleum-based products enhances the corrosion protection.

Strands are also known which are individually protected by a plastic sheath, usually made of a high-density polyethylene (HDPE) or an epoxy, which creates an sealed barrier around the metal wires. A filling compound, which may be of several types (wax, grease, polymer, etc.), fills the gaps existing between the metal wires and the individual sheath in order to enhance the corrosion protection of the strand.

The filling compound allows either slip of the stranded metal wires with respect to their individual sheath (greased-sheathed or waxed-sheathed strand) or, on the contrary, adhesion in order to transmit shear forces between the sheath and the strand (bonded strand).

In the bonded strand, the filling compound is typically a polymer adhering to the wires and to the inside of the sheath. Bonded strands can especially be used when it is necessary to transmit shear forces from the sheath to the metal wires, this being the case for example in the cables supporting suspension bridges whereby the load transmitted by each hanger creates a tangential force on the cable at the clamp where the hanger is fastened (see EP-A-0 855 471).

In the greased-sheathed or waxed-sheathed strand, the filling compound is a lubricant. This has several advantages:

(a) it improves the fatigue behaviour of the strand by lubricating the contacts between its metal wires;

(b) it prevents the tension to which the strand is subjected from generating, due to the shape of the strand, shear and/or tensile stress concentrations in certain portions of the strand, which may cause the sheath to crack, and therefore to no longer seal, exposing the metal to corrosive agents;

(c) in certain configurations, it allows the strands to be replaced one by one, the sheath remaining in place in the structure.

In service, a cable comprising one or more greased-sheathed or waxed-sheathed strands is subjected to tension variations and to temperature variations. These variations cause different elongations of the sheath and of the stranded wires since the plastic and the metal generally do not have the same elasticity and thermal expansion coefficients.

In particular, the sheath usually has a much higher thermal expansion coefficient that the wires. If we consider the case of steel and HDPE, widely used in this kind of strand, the ratio of the two thermal expansion coefficients is of the order of 20. This may result in damage to the sheath, which elongates too much when it is hot or, conversely, a loss of sealing in the end portions of the cable when it is cold, the sheath contracting too much.

An object of the present invention is to avoid these drawbacks, while maintaining at least some of the advantages of the greased-sheathed or waxed-sheathed strand.

SUMMARY OF THE INVENTION

A strand according to the invention comprises a group of twisted metal wires, a plastic sheath containing said group, and a pliant filling compound which fills internal interstices lying between the twisted wires of the group and a peripheral interstice lying between the periphery of the group and the inner face of the sheath. According to the invention, said peripheral interstice has, in a cross section of the strand, an area of between $P \times e_{min}$ and $0.6 \times S2$, where P is the external perimeter of the group of wires, $e_{min}$=0.05 mm and S2 is the cumulative area of the gaps lying between the periphery of the group and the smallest circle within which the group is inscribed.

It is thus possible to obtain "semi-adherent" strands in which the regulated amount of pliant filling compound makes it possible to retain the advantages (a) and (b) of the greased-sheathed strand while still ensuring that the individual sheath follows the macroscopic deformations of the metal wires.

The helical ribs present in the inner face of the sheath penetrate the grooves formed between the adjacent peripheral wires. Cooperation between these ribs and these grooves allows matching of the macroscopic deformations. The amount of filling compound is adjusted so that this penetration is not too great, which might cause locking of the sheath onto the wires by shape adhesion and hence generate stresses in the sheath, especially shear stresses, liable to tear it.

In a preferred embodiment of the invention, the sheath of the strand has a thickness of at least $\phi/5$, where $\phi$ is the diameter of the wires lying at the periphery of the group of twisted wires.

Another aspect of the invention relates to the use of a strand as defined above as structural element working in tension in a building structure. In particular, the strand may form part of a stay cable of a suspension system for the structure, or of a pre-stresing cable for the structure.

A third aspect of the invention relates to a process for manufacturing a strand, comprising the steps of:

coating a group of twisted metal wires with a pliant filling compound so that said compound fills internal interstices lying between the twisted wires of the group and protrudes at the periphery of the group;

wiping the periphery of the coated group so as to leave a regulated amount of filling compound per unit length of the group, said amount representing a volume per unit length of between $S1+(P \times e_{min})$ and $S1+(0.6 \times S2)$, where S1 is the cumulative area of said internal interstices on a cross section of the strand, P is the external perimeter of the group of twisted wires, $e_{min}$=0.05 mm and S2 is the cumulative area of the gaps lying between the periphery of the group and the smallest circle within which the group is inscribed;

extruding a plastic sheath around the group of wires coated with said amount of filling compound.

The wiping step is advantageously carried out by means of a pivotally mounted template, through which the coated group of wires is fed.

DESCRIPTION OF PREFERRED EMBODIMENTS

Figure 1:
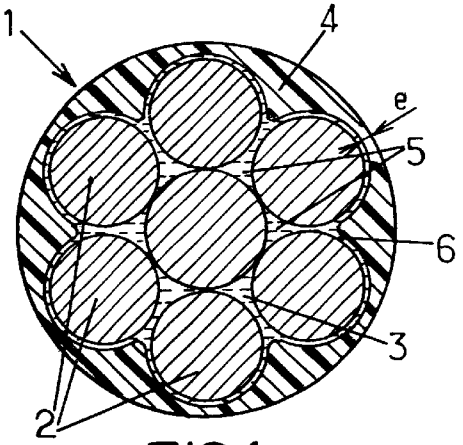
FIG. 1 is a cross-sectional view of a strand according to the invention.

The strand 1 shown in FIG. 1 consists of a plurality of steel wires 2 twisted together, which here are seven in number, namely a central wire and six peripheral wires.

The group of twisted wires 2 is contained within an outer sheath 4 of flexible plastic material, such as a polyolefin, in particular HDPE, or a polyamide.

A pliant filling compound 3, for example an amorphous polymer or a petroleum grease or wax, fills the interstices defined by the wires 2 inside the sheath. Advantageously, this compound 3 has lubrication properties. The aforementioned interstices comprise:

internal interstices 5 whose cross section is in the form of a curvilinear triangle, the sides of which consist of the circumferential portions of three adjacent wires;

a peripheral interstice 6 lying between the peripheral wires of the strand and the inner face of its sheath 4.

Figure 2:
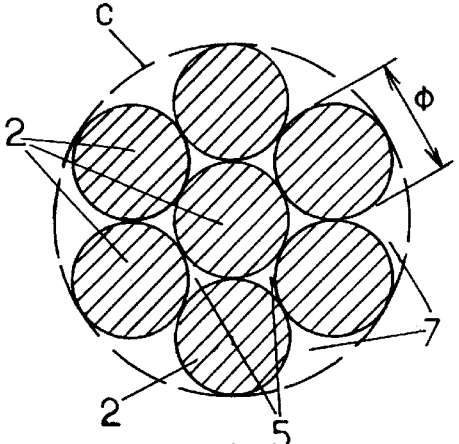
FIG. 2 is a cross-sectional view of the group of metal wires of this strand.

With reference to FIG. 2, we note S1 the cumulative area of the aforementioned curvilinear triangles corresponding to the internal interstices 5, which are six in number in the example in question. We further note S2 the cumulative area, in a cross section of the strand, of the gaps 7 lying between the periphery of the group of steel wires 2 and the smallest circle C within which this group is inscribed. These gaps 7 are also six in number in the example in question, the circle C being tangential to the six peripheral wires of the strand. Finally, P denotes the external perimeter of the group of wires and $\phi$ the diameter of the peripheral wires. A typical value is $\phi$=5 mm, the central wire having a slightly larger diameter, e.g. 5.7 mm.

The peripheral interstice 6 has, in the cross section of the strand, an area of between $P \times e_{min}$ and $0.6 \times S2$, where $e_{min}$ represents a minimum thickness of the compound 3, which is equal to 0.05 mm. The minimum thickness e of the outer sheath 4 is preferably $\phi/5$ or more.

The production of such a strand starts with a group of twisted wires obtained by conventional wire-drawing processes. These wires 2 may have been subjected, in a known manner, to an electrochemical treatment such as galvanizing or galfanizing, aiming to enhance their corrosion resistance.

Figure 3:
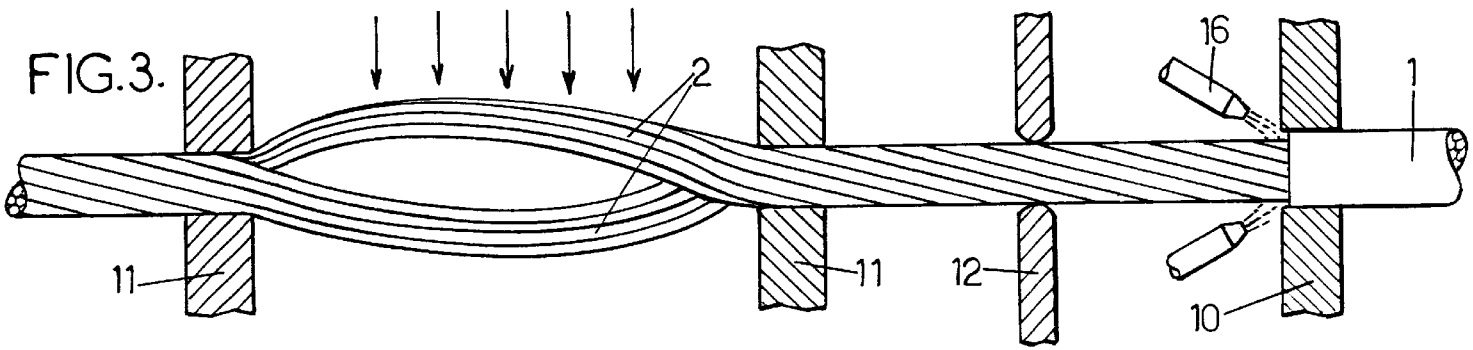
FIG. 3 is a diagram of a plant suitable for implementing a process according to the invention.

Referring to FIG. 3, one section of the strand is untwisted before it is passed through the die 10 for extruding the plastic of the sheath 4, so as to spread out its wires 2. This may be carried out by gripping the ends of the section in two jaws 11 which are subjected to a relative twisting couple in the opposite sense to the stranding pitch. The pliant filling compound is introduced by spraying or injection into the untwisted section. After the jaws 11 have been released, the wires close up, trapping the compound 3 in the internal interstices 5 and making this compound protrude at the periphery of the group of wires. Next, the section thus treated is fed through a wiping template 12 used for leaving the appropriate amount of compound 3 on the group of twisted wires. Downstream of the template 12 is the system 16 for injecting the plastic of the sheath 4 and then the extrusion die 10 through which the strand is pulled, in order to define its external shape and the thickness e of the sheath.

The amount of compound 3 left by the wiping template 12 represents, per unit length of the strand, a volume of between $S_{min}=S1+(P \times e_{min})$ and $S_{max}=S1+(0.6 \times S2)$ so as to meet the aforementioned condition on the dimension of the peripheral interstice 6.

Figure 4:
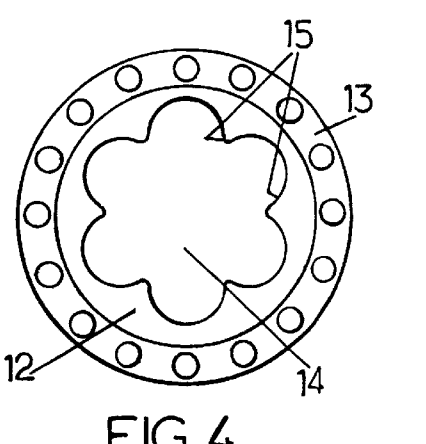
FIG. 4 is a diagram of wiping means of the plant in FIG. 3.

The wiping template 12 is illustrated in FIG. 4. It is mounted on the inner ring of a ball bearing 13 so as to be free to rotate. The strand coated with the compound 3 passes through an opening 14 in the template 12, the area of which is between $S+S_{min}$ and $S+S_{max}$, where S is the cumulative area of the cross sections of the seven wires 2. The shape of this opening 14 matches that of the group of wires associated with the peripheral interstice 6. Its perimeter thus has six teeth 15 which fit into the grooves existing between the peripheral wires of the strand. The free rotation of the template 12 when the strand is pulled through it allows these teeth 15 to follow the helical path of the grooves, while maintaining the desired amount of compound 3.

The strand thus produced is suitable for forming a structural element working in tension in a building structure, which fully meets the requirements mentioned in the introduction. It will advantageously be used in stay cables (see, e.g., EP-A-0 323 285) or pre-stressing cables.

What is claimed is:

1. Strand comprising a group of twisted metal wires, a plastic sheath containing said group, and a pliant filling compound filling internal interstices lying between the twisted wires of the group and a peripheral interstice lying between a periphery of the group and an inner face of the sheath, wherein said peripheral interstice has, in a cross section of the strand, an area of between $P \times e_{min}$ and $0.6 \times S2$, where P is an external perimeter of the group of wires, $e_{min}$=0.05 mm and S2 is a cumulative area of a plurality gaps lying between the periphery of the group and the smallest circle within which the group is inscribed.

2. Strand according to claim 1, wherein the sheath has a thickness of at least $\phi/5$, where $\phi$ is a diameter of the wires lying at the periphery of the group.

3. Process for manufacturing a strand, comprising the steps of:

coating a group of twisted metal wires with a pliant filling compound so that said compound fills internal interstices lying between the twisted wires of the group and protrudes at a periphery of the group;

wiping the periphery of the coated group so as to leave a regulated amount of filling compound per unit length of the group, said amount representing a volume per unit length of between $S1+(P \times e_{min})$ and $S1+(0.6 \times S2)$, where S1 is a cumulative area of said internal interstices on a cross section of the strand, P is an external perimeter of the group of twisted wires, $e_{min}$=0.05 mm and S2 is a cumulative area of a plurality of gaps lying between the periphery of the group and the smallest circle within which the group is inscribed;

extruding a plastic sheath around the group of wires coated with said amount of filling compound.

4. Process according to claim 3, wherein the wiping step comprises feeding the coated group of wires through a pivotally mounted template.

5. Process according to claim 3, wherein the sheath is given a thickness of at least $\phi/5$, where $\phi$ is a diameter of the wires lying at the periphery of the group.

* * * * *